US010514204B2

(12) United States Patent
Avila et al.

(10) Patent No.: US 10,514,204 B2
(45) Date of Patent: Dec. 24, 2019

(54) MULTIPORT EXTRUDED HEAT EXCHANGER

(71) Applicant: Carrier Corporation, Jupiter, FL (US)

(72) Inventors: Luis Felipe Avila, Manlius, NY (US); Bruce J. Poplawski, Mattydale, NY (US); Kazuo Saito, Jamesville, NY (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 0 days.

(21) Appl. No.: 15/508,828

(22) PCT Filed: Sep. 1, 2015

(86) PCT No.: PCT/US2015/047916

§ 371 (c)(1),
(2) Date: Mar. 3, 2017

(87) PCT Pub. No.: WO2016/036726

PCT Pub. Date: Mar. 10, 2016

(65) Prior Publication Data

US 2017/0276433 A1 Sep. 28, 2017

Related U.S. Application Data

(60) Provisional application No. 62/046,355, filed on Sep. 5, 2014.

(51) Int. Cl.
*F28D 1/02* (2006.01)
*B21D 53/06* (2006.01)
(Continued)

(52) U.S. Cl.
CPC ..... *F28D 1/02* (2013.01); *B21D 11/10* (2013.01); *B21D 53/06* (2013.01); *F28D 1/0246* (2013.01);
(Continued)

(58) Field of Classification Search
CPC .... F28D 1/02; F28D 1/047; F28D 1/04; F28F 1/02; F28F 1/12; F28F 9/0219; F28F 1/10; F28F 1/105; F28F 1/126; F28F 1/128
(Continued)

(56) References Cited

U.S. PATENT DOCUMENTS 2,286,271 A * 6/1942 Higham ..... F28F 1/10 126/91 A
3,596,495 A * 8/1971 Huggins ..... B21D 53/08 165/109.1
(Continued)

FOREIGN PATENT DOCUMENTS

CN 101532786 A 9/2009
CN 101890446 A 11/2010
(Continued)

OTHER PUBLICATIONS

International Search Report for International Appln. No. PCT/US2015/047916; International Filing Date: Sep. 1, 2015; dated Dec. 9, 2015; 5 pages.
(Continued)

*Primary Examiner* — Justin M Jonaitis
(74) *Attorney, Agent, or Firm* — Cantor Colburn LLP

(57) ABSTRACT

A heat exchanger is provided including a first manifold and a second manifold separated from the first manifold. A plurality of heat exchange tube segments are arranged in spaced parallel relationship and fluidly couple the first and second manifold. Each of the plurality of tube segments includes a first heat exchange tube and a second heat exchange tube at least partially connected by a web extending there between. The plurality of heat exchange tube segments includes a bend defining a first section and a second section of the heat exchange tube segments. The first section is arranged at an angle to the second section. A
(Continued)

plurality of first fins extends form the first section of the heat exchange tube segments and a plurality of second fins extends from the second section of the heat exchange tube segments.

13 Claims, 6 Drawing Sheets

(51) Int. Cl.

| | |
|---|---|
| ***F28D 1/047*** | (2006.01) |
| ***F28F 1/02*** | (2006.01) |
| ***F28F 1/12*** | (2006.01) |
| ***B21D 11/10*** | (2006.01) |

(52) U.S. Cl.
CPC ..... *F28D 1/047* (2013.01); *F28D 1/0476* (2013.01); *F28F 1/02* (2013.01); *F28F 1/022* (2013.01); *F28F 1/12* (2013.01); *F28F 1/128* (2013.01); *F28F 2210/08* (2013.01); *F28F 2215/04* (2013.01); *F28F 2255/00* (2013.01)

(58) Field of Classification Search
USPC ..... 165/153, 148, 152; 29/890.03, 890.045, 29/890.046, 890.047, 34 R
See application file for complete search history.

(56) References Cited

U.S. PATENT DOCUMENTS

| | | | | |
|---|---|---|---|---|
| 3,751,935 | A | 8/1973 | MacCracken et al. | |
| 4,381,592 | A | 5/1983 | Venables, III et al. | |
| 4,732,311 | A * | 3/1988 | Hasegawa | B23K 1/0012 228/138 |
| 5,531,268 | A * | 7/1996 | Hoshino | F28D 1/0476 165/149 |
| 5,954,125 | A * | 9/1999 | Mantegazza | B21D 53/085 165/149 |
| 6,964,296 | B2 | 11/2005 | Memory et al. | |
| 7,699,095 | B2 | 4/2010 | Beamer et al. | |
| 2003/0106677 | A1 * | 6/2003 | Memory | F25B 39/04 165/135 |
| 2003/0183378 | A1 | 10/2003 | Memory et al. | |
| 2007/0169922 | A1 * | 7/2007 | Pautler | F28D 1/05366 165/153 |
| 2008/0141525 | A1 * | 6/2008 | Breiding | B23K 1/0012 29/726.5 |
| 2008/0141708 | A1 | 6/2008 | Obosu et al. | |
| 2008/0173434 | A1 | 7/2008 | Matter et al. | |
| 2008/0202733 | A1 | 8/2008 | Samuelson et al. | |
| 2016/0054075 | A1 * | 2/2016 | Taras | F28D 1/0391 165/173 |

FOREIGN PATENT DOCUMENTS

| | | | | | |
|---|---|---|---|---|---|
| CN | 201652995 | U | | 11/2010 | |
| CN | 103196259 | A | | 7/2013 | |
| CN | 203719499 | U | | 7/2014 | |
| JP | 03099193 | | | 4/1991 | |
| JP | H04187990 | A | | 7/1992 | |
| JP | 2851540 | B2 | | 1/1999 | |
| JP | 2000154992 | A | | 6/2000 | |
| JP | 2001082832 | | | 3/2001 | |
| JP | 2001082832 | A | * | 3/2001 | F28D 1/0476 |
| JP | 2002243381 | A | | 8/2002 | |
| JP | 2007192474 | | | 2/2007 | |
| WO | 2008/064257 | A2 | | 5/2008 | |

OTHER PUBLICATIONS

Written Opinion of the International Searching Authority for International Appln. No. PCT/US2015/047916; International Filing Date: Sep. 1, 20151; dated Dec. 9, 2015; 7 pages.

International Preliminary Report on Patentability for International Application No. PCT/US2015/047916, dated Mar. 7, 2017, 8 pp.

National Intellectual Property Administration, P.R. China, First Office Action for Patent Application No. 201580047481.4, dated Sep. 29, 2018 (45 pp.)

* cited by examiner

MULTIPORT EXTRUDED HEAT EXCHANGER

CROSS REFERENCE TO RELATED APPLICATIONS

This application is a National Stage application of PCT/US2015/047916, filed Sep. 1, 2015, which claims priority of U.S. Provisional Application No.: 62/046,355, filed Sep. 5, 2014, both of which are incorporated by reference in their entirety herein.

BACKGROUND

This invention relates generally to heat exchangers and, more particularly, to a microchannel heat exchanger having multiple port extrusions and a bent configuration.

Refrigerant vapor compression systems are well known in the art. Air conditioners and chillers employing refrigerant vapor compression cycles are commonly used for cooling, or both cooling and heating air supplied to a climate controlled zone of a building. Conventionally these refrigerant vapor compression systems include a compressor, condenser, and expansion device, and an evaporator connected in refrigerant flow communication to form a closed refrigerant circuit.

In some refrigerant vapor compression systems, one of the condenser and the evaporator is a parallel tube heat exchanger. Such heat exchangers have a plurality of parallel refrigerant flow paths provided by a plurality of tubes extending in parallel relationship between an inlet header and an outlet header. Flat, rectangular, or oval shape multichannel tubes are commonly used. Each multichannel tube has a plurality of flow channels extending longitudinally in parallel relationship over the length of the tube, each channel providing a small cross-sectional flow area refrigerant flow path. An inlet header receives refrigerant from the refrigerant circuit and distributes that refrigerant flow amongst the plurality of flow paths through the heat exchanger. The outlet header collects the refrigerant flow as it leaves the respective flow paths and directs the collected flow back to the refrigerant vapor compression system.

In certain applications, the parallel tube heat exchanger is required to fit into a particularly sized housing to minimize the footprint of the air conditioning system. In other applications, the parallel tube heat exchanger is required to fit into an airflow duct of a particular size. In such instances, it may be necessary to bend or shape the parallel tube heat exchanger to accommodate these restrictions while ensuring an undiminished ability to cool or heat the climate controlled zone. One practice of bending and shaping parallel tube heat exchangers involves bending the heat exchange assembly around a cylinder. During this process, force is applied to one side of the assembly to wrap it around a partial turn of the cylinder to provide a uniform and reproducible method of bending the assembly.

One problem with this method is that composite multiport extruded (MPE) microchannel heat exchangers are significantly stiffer, and therefore more difficult to bend than regular MPE multichannel heat exchangers. In addition, newer refrigeration systems having a larger capacity may require a compound heat exchanger construction, which resembles two slabs arranged side by side and joined at the ends. This kind of construction cannot be easily bent without major damage unless large bend radii are used, which results in the heat exchanger being too large to fit within the desired sizing envelope.

SUMMARY OF THE INVENTION

According to one embodiment of the invention, a heat exchanger is provided including a first manifold and a second manifold separated from the first manifold. A plurality of heat exchange tube segments are arranged in spaced parallel relationship and fluidly couple the first and second manifold. Each of the plurality of tube segments includes a first heat exchange tube and a second heat exchange tube at least partially connected by a web extending there between. The plurality of heat exchange tube segments includes a bend defining a first section and a second section of the heat exchange tube segments. The first section is arranged at an angle to the second section. A plurality of first fins extends form the first section of the heat exchange tube segments and a plurality of second fins extends from the second section of the heat exchange tube segments.

In addition to one or more of the features described above, or as an alternative, in further embodiments the bend wraps about an axis arranged perpendicular to a longitudinal axis of the heat exchange tube segments.

In addition to one or more of the features described above, or as an alternative, in further embodiments the bend of each heat exchange tube segment includes a slight twist.

In addition to one or more of the features described above, or as an alternative, in further embodiments each of the plurality of first heat exchanger tubes and the plurality of second heat exchanger tubes are microchannel tubes having a plurality of discrete flow channels formed therein.

In addition to one or more of the features described above, or as an alternative, in further embodiments the plurality of first heat exchanger tubes and the plurality of second heat exchanger tubes are substantially identical.

In addition to one or more of the features described above, or as an alternative, in further embodiments the plurality of first heat exchanger tubes and the plurality of second heat exchanger tubes are different.

In addition to one or more of the features described above, or as an alternative, in further embodiments at least one of the plurality of first fins and the plurality of second fins is mounted to a surface of the heat exchange tube segments.

In addition to one or more of the features described above, or as an alternative, in further embodiments at least one of the plurality of first fins and the plurality of second fins are integrally formed with a surface of the heat exchange tube segments.

In addition to one or more of the features described above, or as an alternative, in further embodiments the plurality of first fins and the plurality of second fins are substantially identical.

In addition to one or more of the features described above, or as an alternative, in further embodiments the plurality of first fins and the plurality of second fins are different.

According to another embodiment of the invention, a method of bending a heat exchanger having a plurality of heat exchange tube segments arranged in a spaced parallel relationship and fluidly coupling a first manifold and second manifold is provided. Each of the plurality of tube segments includes at least a first heat exchanger tube and a second heat exchanger tube at least partially connected by a web. The method includes installing at least one spacer at a bend portion between adjacent heat exchange tube segments. The plurality of heat exchange tube segments are bent about an axis arranged perpendicular to a longitudinal axis of the heat exchange tube segments to achieve a desired angle. The at least one spacer is removed.

In addition to one or more of the features described above, or as an alternative, in further embodiments the bend portion defines a first section and a second section of each heat exchange tube segment, and the desired angle is measured between the first section and the second section.

In addition to one or more of the features described above, or as an alternative, in further embodiments the at least one spacer is formed from a non-conductive, semi-rigid plastic.

BRIEF DESCRIPTION OF THE DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION

Figure 1:
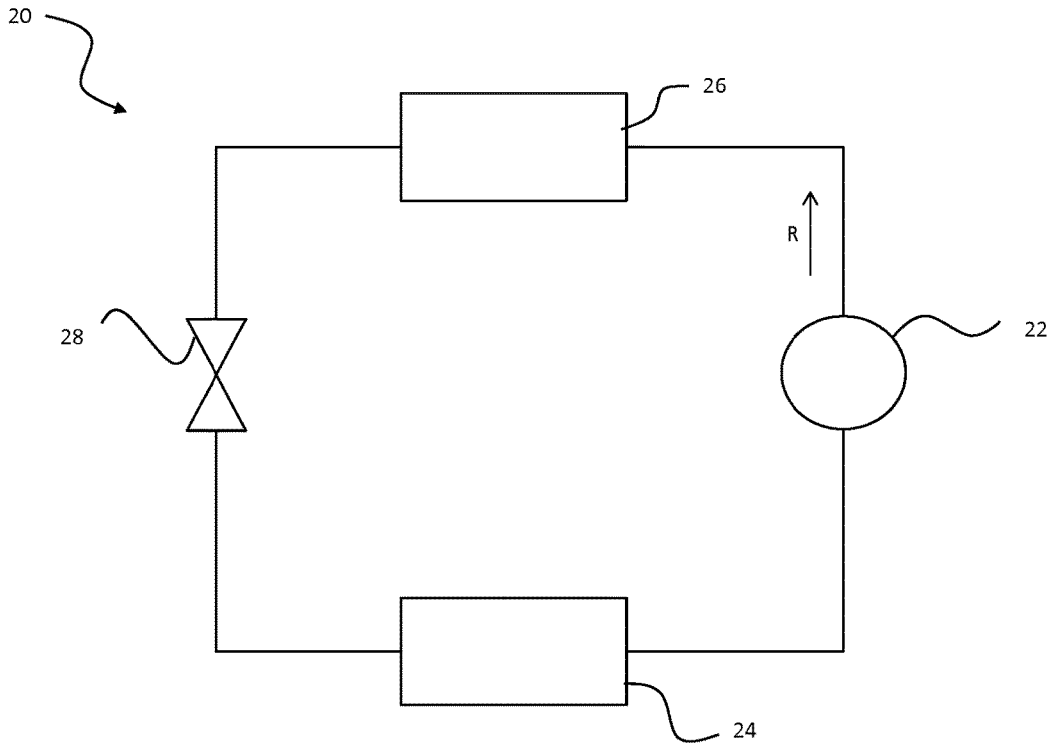
FIG. 1 is a schematic diagram of an example of a vapor refrigeration cycle of a refrigeration system.

Referring now to FIG. 1, a vapor compression or refrigeration cycle 20 of an air conditioning system is schematically illustrated. Exemplary air conditioning systems include, but are not limited to, split, packaged, chiller and rooftop systems for example. A refrigerant R is configured to circulate through the vapor compression cycle 20 such that the refrigerant R absorbs heat when evaporated at a low temperature and pressure and releases heat when condensed at a higher temperature and pressure. Within this cycle 20, the refrigerant R flows in a counterclockwise direction as indicated by the arrow. The compressor 22 receives refrigerant vapor from the evaporator 24 and compresses it to a higher temperature and pressure, with the relatively hot vapor then passing to the condenser 26 where it is cooled and condensed to a liquid state by a heat exchange relationship with a cooling medium (not shown) such as air or water. The liquid refrigerant R then passes from the condenser 26 to an expansion device 28, wherein the refrigerant R is expanded to a low temperature two-phase liquid/vapor state as it passes to the evaporator 24. The low pressure vapor then returns to the compressor 22 where the cycle is repeated. It has to be understood that the refrigeration cycle 20 depicted in FIG. 1 is a simplistic representation of an HVAC&R system, and many enhancements and features known in the art may be included in the schematic.

Figure 2:
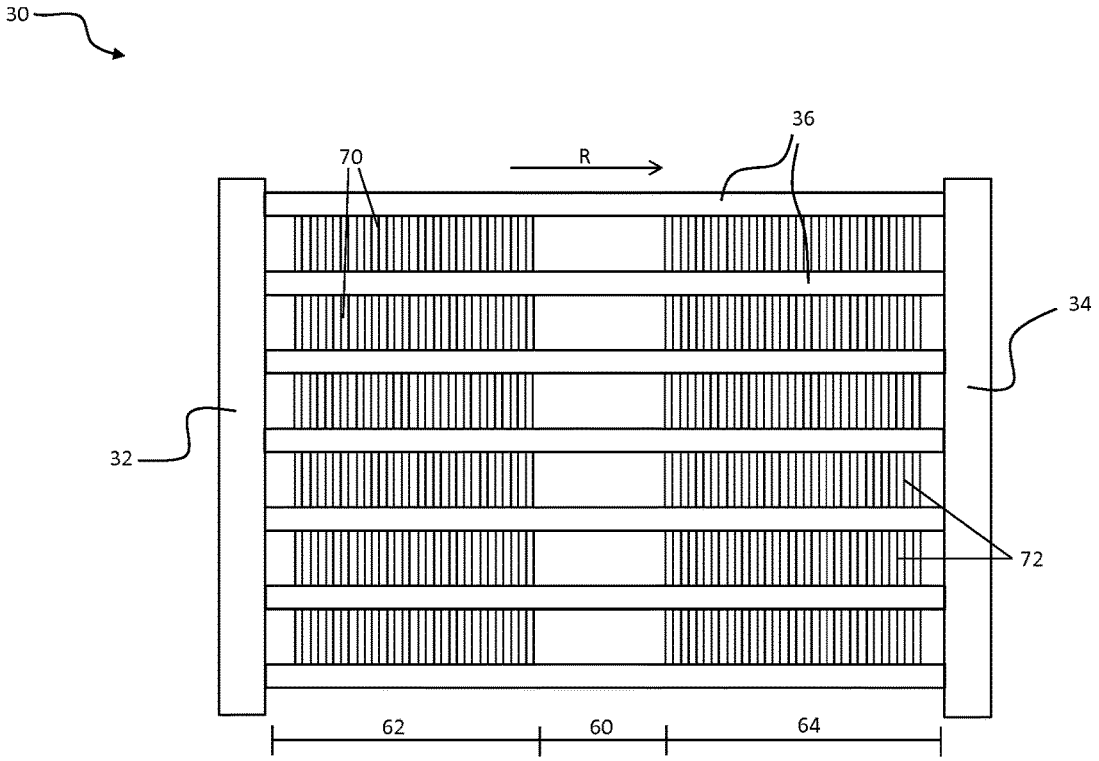
FIG. 2 is a side view of a microchannel heat exchanger according to an embodiment of the invention prior to a bending operation.

Referring now to FIG. 2, a heat exchanger 30 configured for use in the vapor compression system 20 is illustrated in more detail. The heat exchanger 30 may be used as either a condenser 24 or an evaporator 28 in the vapor compression system 20. The heat exchanger 30 includes a first manifold or header 32, a second manifold or header 34 spaced apart from the first manifold 32, and a plurality of tube segments 36 extending in a spaced, parallel relationship between and connecting the first manifold 32 and the second manifold 34. In the illustrated, non-limiting embodiments, the first header 32 and the second header 34 are oriented generally vertically and the heat exchange tube segments 36 extend generally horizontally between the two headers 32, 34. However, other configurations, such as where the first and second headers 32, 34 are arranged substantially horizontal are also within the scope of the invention.

Figure 3:
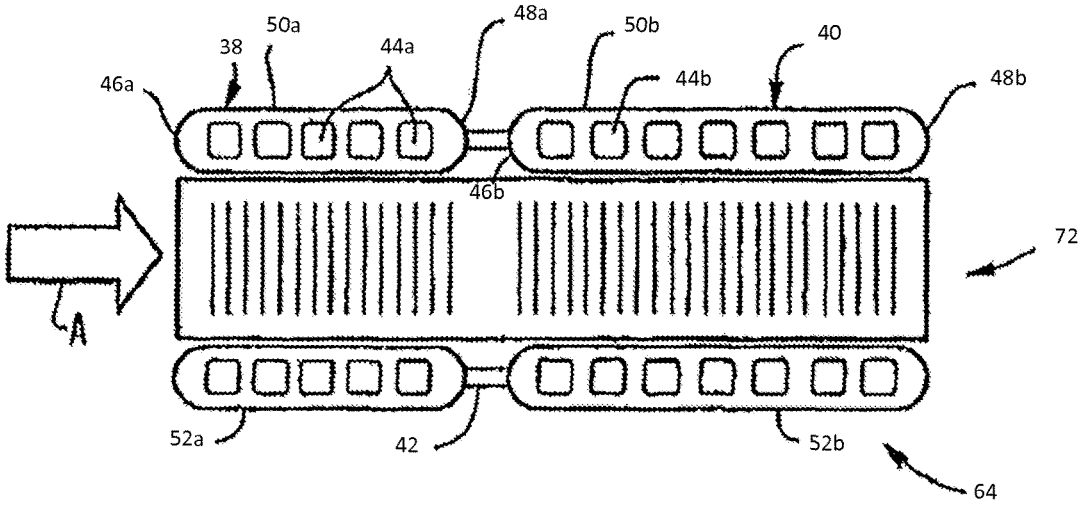
FIG. 3 is a cross-sectional view of a tube segment of a microchannel heat exchanger according to an embodiment of the invention.
Figure 4:
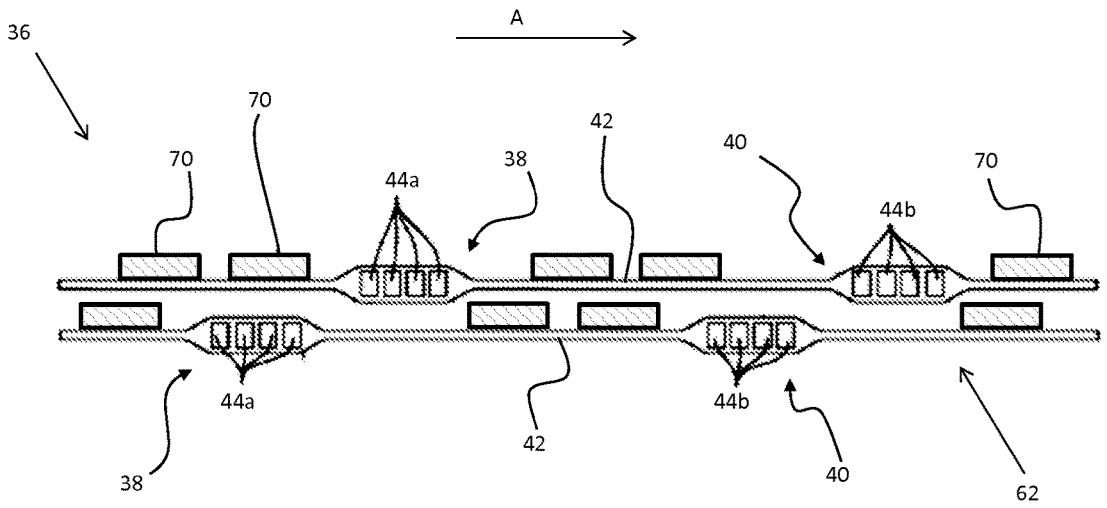
FIG. 4 is a cross-sectional view of a tube segment of a microchannel heat exchanger according to an embodiment of the invention.

As illustrated in the cross-sections of FIGS. 3 and 4, each of the plurality of tube segments 36 extending between the first manifold 32 and the second manifold 34 is a multiport extruded (MPE) tube segment 36 and includes at least a first heat exchange tube 38 and a second heat exchange tube 40 connected by a web 42 extending at least partially there between. In one embodiment, the web 42 arranged at the outermost tube segments 36 includes a plurality of openings. The plurality of second heat exchange tubes 40 may have a width substantially equal to or different from the width of the plurality of first heat exchange tubes 38. Although the second heat exchange tube 40, as illustrated in FIG. 3, is wider than the first heat exchange tube 38, other configurations where the plurality of first heat exchange tubes 38 are equal to or wider than the plurality of second heat exchange tubes 40 are within the scope of the invention.

An interior flow passage of each heat exchange tube 38,40 may be divided by interior walls into a plurality of discrete flow channels 44*a*, 44*b* that extend over the length of the tube segments 36 and establish fluid communication between the respective first and second manifolds 32, 34. The interior flow passages of the first heat exchange tubes 38 may be divided into a different number of discrete flow channels 44 than the interior flow passages of the second heat exchange tubes 40. The flow channels 44*a*, 44*b* may have any shape cross-section, such as a circular cross-section, a rectangular cross-section, a trapezoidal cross-section, a triangular cross-section, or another non-circular cross-section for example. The plurality of heat exchange tube segments 36 including the discrete flow channels 44*a*, 44*b* may be formed using known techniques, such as extrusion for example.

Each first heat exchange tube 38 and second heat exchange tube 40 has a respective leading edge 46*a*, 46*b*, a trailing edge 48*a*, 48*b*, a first surface 50*a*, 50*b*, and a second surface 52*a*, 52*b* (FIG. 3). The leading edge 46*a*, 46*b* of each heat exchange tube 38, 40 is upstream of its respective trailing edge 48*a*, 48*b* with respect to an airflow A through the heat exchanger 30.

Figure 5:
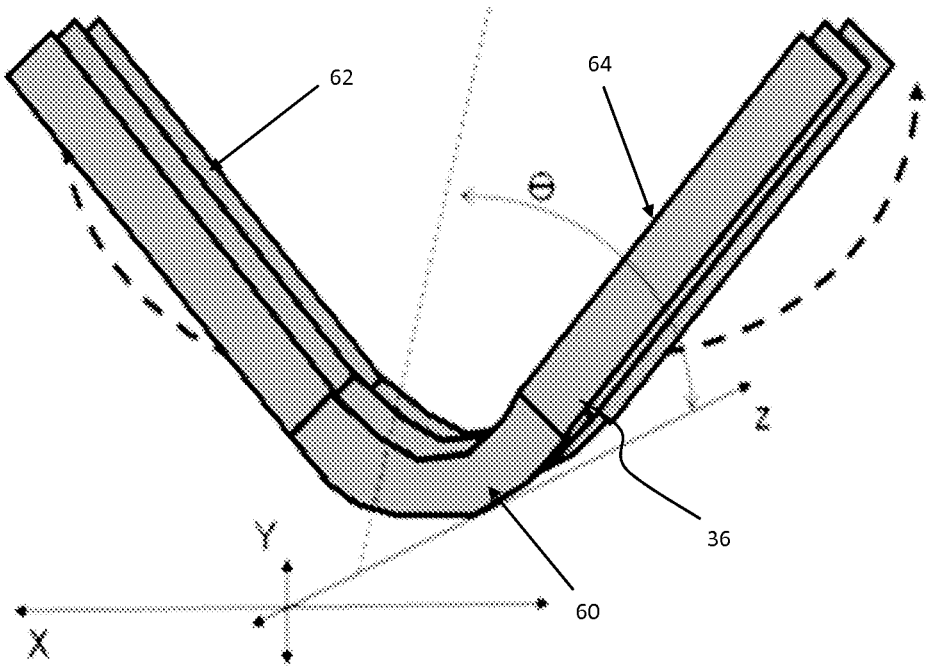
FIG. 5 is a perspective view of a microchannel heat exchanger according to an embodiment of the invention.

Referring now to FIG. 5, each tube segment 36 of the heat exchanger 30 includes at least one bend 60, such that the heat exchanger 30 has a multi-pass configuration relative to the airflow A. The bend 60 is generally formed about an axis extending substantially perpendicular to the longitudinal axis or the discrete flow channels 44*a*, 44*b* of the tube segments 36. In the illustrated embodiment, the bend 60 is a ribbon fold; however other types of bends are within the scope of the invention. In the illustrated, non-limiting embodiment, the bend 60 is formed at an approximate midpoint of the tube segments 36 between the opposing first and second manifolds 32, 34.

The bend 60 at least partially defines a first section 62 and a second section 64 of each of the plurality of tube segments 36. As shown in the FIG. the bend 60 can be formed such that the first section 62 of each tube segment 36 is positioned at an obtuse angle with respect to the second section 64. Alternatively, or in addition, the bend 60 can also be formed such that the first section 62 is arranged at either an acute angle or substantially parallel to the second section 64. The bend 60 allows for the formation of a heat exchanger 30 having a conventional A-coil or V-coil shape.

As previously stated, the heat exchanger 30 includes a multi-pass configuration as a result of the bend 60 formed therein. For example, one or both of the first heat exchanger tube 38 and the second heat exchanger tube 40 within the first section 62 of a tube segment 36 may define a first pass, and one or both of the first heat exchanger tube 38 and the second heat exchanger tube 40 within the second section 64 of the same tube segment 36 or a different tube segment 36 may define a subsequent pass. Any multipass flow configuration is within the scope of the invention. In one embodiment, the first heat exchanger tube 38 and the second heat exchanger tubes 40 within the same first section 62 or second section 64 are configured as different passes within the refrigerant flow path of the heat exchanger 30.

Referring again to FIGS. 2-4, a plurality of first fins 70 extend from the first section 62 and a plurality of second fins 72 extend from the second section 64 of each tube segment 36. In the illustrated, non-limiting embodiment, no fins are arranged within the bend 60 of the plurality of tube segments 36. The plurality of first fins 70 and second fins 72 may be substantially identical, or alternatively, may be different. As shown in FIG. 4, the fins 70 of the first section 62 of tube segments 36 may be integrally formed with the tube segments 36, such as louvers formed in the web 42 and extending into the path of the airflow A through the heat exchanger 30 for example.

Alternatively, the fins 72 may be mounted to a surface of second section 64 of the tube segments 36 (FIG. 3). The first and second fins 70, 72 may be formed of a fin material tightly folded in a ribbon-like serpentine fashion thereby providing a plurality of closely spaced fins that extend generally orthogonal to the flattened tube segments 36. In the non-limiting embodiment depicted in FIG. 3, each folded fin 72 extends from a leading edge 46*a* of a first heat exchange tube 38 to the trailing edge of 48*b* of an adjacent second heat exchange tube 40. However, in other embodiments, the fins 70, 72 may extend over only a portion of a width of the tube segments 36.

Heat exchange between the one or more fluids within the plurality of tube segments 36 and an air flow A, occurs through the exterior surfaces 48, 50 of the heat exchange tubes 36, collectively forming a primary heat exchange surface, and also through the heat exchange surface of the fins 70, 72 which forms a secondary heat exchange surface.

Figure 6:
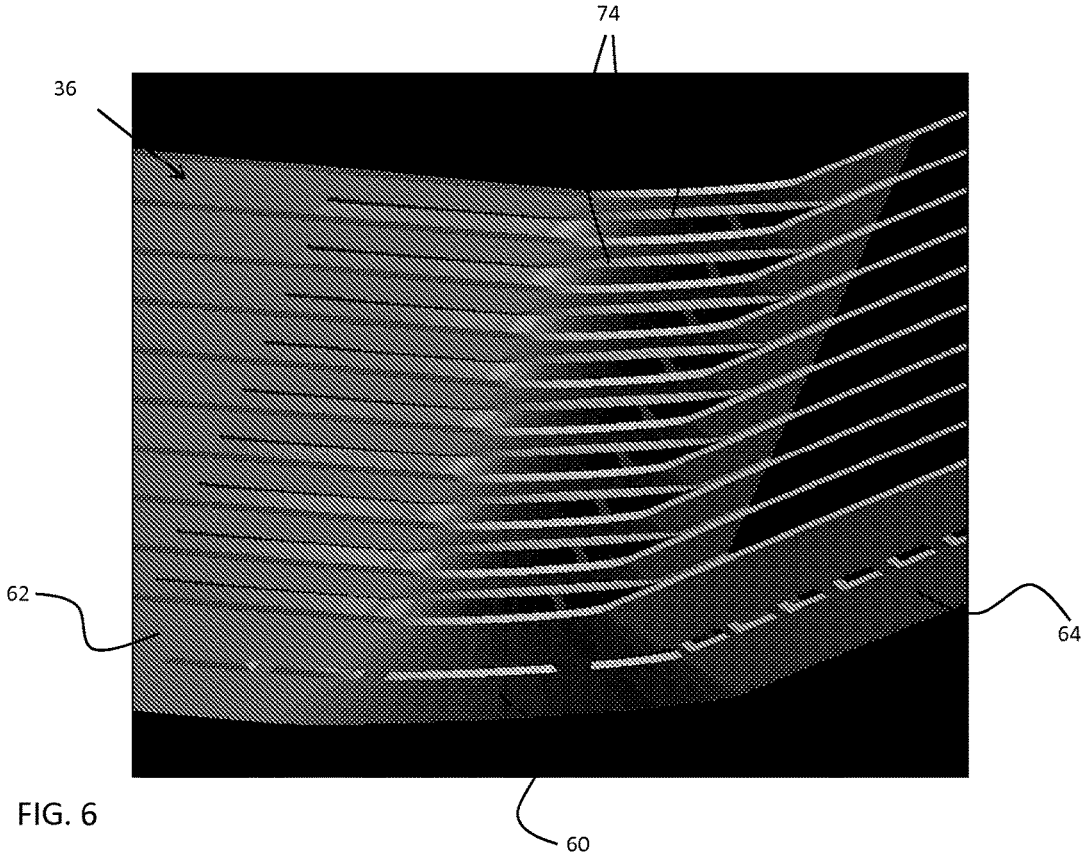
FIG. 6 is a perspective view of the bend of a microchannel heat exchanger according to an embodiment of the invention.

Referring now to FIG. 6, to prevent deformation of the tube segments 36 during the bending process, non-conductive, semi-rigid plastic spacers 74 are positioned between adjacent tube segments 36, specifically in the bend portion 60 having no fins extending therefrom of the unbent heat exchanger 30 (FIG. 2). The spacers 74 are then removed after completion of the bending process when the first section 62 and the second section 64 are arranged at a desired angle relative to one another. The spacers 74 are intended to prevent collapse of the tube segments 36 and also conduction losses after the bend 60 is formed. As the bend progresses towards the first section 62 and the second section 64, the bend 60 includes a slight twist to align the first and second headers 32, 34. As a result, the force required to bend the heat exchanger 30 is significantly reduced and damage to the heat exchanger 30 is avoided.

The method of bending a multiport extruded (MPE) microchannel heat exchanger 30 described herein results in a heat exchanger 30 having a reduced bending radius. As a result, the heat exchanger 30 may be adapted to fit within the sizing envelopes defined by existing air conditioning and refrigeration systems.

While the present invention has been particularly shown and described with reference to the exemplary embodiments as illustrated in the drawing, it will be recognized by those skilled in the art that various modifications may be made without departing from the spirit and scope of the invention. Therefore, it is intended that the present disclosure not be limited to the particular embodiment(s) disclosed as, but that the disclosure will include all embodiments falling within the scope of the appended claims. In particular, similar principals and ratios may be extended to the rooftops applications and vertical package units.

We claim:

1. A heat exchanger comprising:

a first manifold;

a second manifold separated from the first manifold;

a plurality of heat exchange tube segments arranged in spaced parallel relationship and fluidly coupling the first manifold and the second manifold, each of the plurality of tube segments including at least a first heat exchanger tube and a second heat exchanger tube at least partially connected by a web extending there between, one or more openings being formed in the web, the plurality of heat exchange tube segments including a bend defining a first section of the heat exchanger tube segments and a second section of the heat exchange tube segments, the first section being arranged at an angle to the second section;

a plurality of first fins extending from the first section of the heat exchange tube segments, and a plurality of second fins extending from the second section of the heat exchange tube segments, wherein at least one of the plurality of first fins and the plurality of second fins extends from the web.

2. The heat exchanger according to claim 1, wherein the bend wraps about an axis arranged perpendicular to a longitudinal axis of the plurality of heat exchange tube segments.

3. The heat exchanger according to claim 1, wherein the bend of each heat exchange tube segment includes a slight twist.

4. The heat exchanger according to claim 1, wherein each of the plurality of first heat exchanger tubes and the plurality of second heat exchanger tubes are microchannel tubes having a plurality of discrete flow channels formed therein.

5. The heat exchanger according to claim 1, wherein the plurality of first heat exchanger tubes and the plurality of second heat exchanger tubes are identical.

6. The heat exchanger according to claim 1, wherein the plurality of first heat exchanger tubes and the plurality of second heat exchanger tubes are different.

7. The heat exchanger according to claim 1, wherein at least one of the plurality of first fins and the plurality of second fins is mounted to a surface of the heat exchange tube segments.

8. The heat exchanger according to claim 1, wherein at least one of the plurality of first fins and the plurality of second fins integrally formed with a surface of the heat exchange tube segments.

9. The heat exchanger according to claim 1, wherein the plurality of first fins and the plurality of second fins are identical.

10. The heat exchanger according to claim 1, wherein the plurality of first fins and the plurality of second fins are different.

11. A method of forming a heat exchanger having a plurality of heat exchange tube segments arranged in spaced parallel relationship and fluidly coupling a first manifold and a second manifold, each of the plurality of tube segments including at least a first heat exchanger tube and a second heat exchanger tube at least partially connected by a web extending there between, the method comprising the steps of:

installing at least one spacer at a bend portion in between adjacent heat exchange tube segments;

bending the plurality of heat exchange tube segments about an axis arranged perpendicular to a longitudinal axis of the plurality of heat exchange tube segments to achieve a desired angle; and removing the at least one spacer; and forming one or more fins at the web of at least one of the plurality of heat exchange tube segments.

12. The method according to claim 11, wherein the bend portion defines a first section and a second section of each heat exchange tube segment and the desired angle is measured between the first section and the second section.

13. The method according to claim 11, wherein the at least one spacer is formed from a non-conductive, semi-rigid plastic.

* * * * *